United States Patent [19]

Miller, Jr.

[11] Patent Number: 4,955,844

[45] Date of Patent: Sep. 11, 1990

[54] SITTING DOLL WITH BENDABLE KNEES

[76] Inventor: John B. Miller, Jr., 15415 W. Willowwind Cir., Houston, Tex. 77071

[21] Appl. No.: 400,950

[22] Filed: Aug. 31, 1989

[51] Int. Cl.[5] ..... A63H 33/26

[52] U.S. Cl. ..... 446/330; 446/326; 446/296; 446/268; 52/39

[58] Field of Search ..... 446/326, 354, 356, 296, 446/359, 371, 375, 376, 268, 330, 333, 177, 303; 52/39; 74/42

[56] References Cited

U.S. PATENT DOCUMENTS

| | | | |
|---|---|---|---|
| 2,927,467 | 3/1960 | Sala | 74/42 |
| 3,922,813 | 12/1975 | Terzian et al. | 446/354 |
| 4,266,367 | 5/1981 | Kuna et al. | 446/177 |
| 4,802,878 | 2/1989 | Terzian et al. | 446/303 X |

*Primary Examiner*—Robert A. Hafer
*Assistant Examiner*—Beth Anne Cicconi
*Attorney, Agent, or Firm*—Kenneth A. Roddy

[57] ABSTRACT

A doll having bendable knees is capable of moving between a standing position and a sitting position. The doll has a pair of arm members pivotally connected to a torso at the shoulder and a pair of leg members pivotally connected to the torso at the hip and each leg member has an upper member and a lower leg member joined thereto at the knee. The upper and lower leg members are movable relative to one another about the knee joint. The arm members are connected to the leg members inside the torso by cables. In the standing position, the arms and legs are positioned generally vertical relative to the torso. Moving one arm member from the vertical position to raised position generally perpendicular to the torso causes simultaneous movement of the upper leg members between the standing position and a sitting position with the upper leg members aligned generally perpendicular to the torso. The lower leg may be allowed to remain in a generally vertical position and to be moved upwardly as the upper leg member is pivotally moved about the hip region to simulate bending at the knees. The lower leg member may also be held or fixed in a generally vertical position such that the pivotal force applied to the upper leg member at the hip region is transferred to the knee joint to cause the upper leg member to be pivoted downward relative to the lower leg member about the knee joint and carry the torso downwardly therewith to simulate bending at the knees and the doll will assume a sitting position as the torso is carried down.

11 Claims, 2 Drawing Sheets

SITTING DOLL WITH BENDABLE KNEES

BACKGROUND OF THE INVENTION

1. Field of the Invention

This invention relates generally to articulated dolls, and more particularly to a doll having bendable knees which is capable of moving between a standing position and a sitting position.

2. Brief Description of the Prior Art

There are various articulated dolls and toys that are capable of various movements and physiological functions by means of internal arrangements.

Sala, U.S. Pat. No. 2,927,467 discloses a figure with independently movable limbs. The arms are connected to rotatable shafts, and the limbs on one side of the body are connected with one another by a connecting rod and one of the limbs is rotatably connected by an eccentric member rotated by a clockwork mechanism by a connecting rod and the limbs on the other side of the body are connected by connecting rods with an eccentric member also rotated by the clockwork mechanism.

Kuna et al, U.S. Pat. No. 4,266,367 discloses an articulated doll having an internal mechanism which allows the doll to sit down from a standing position. With the doll in a standing position, the user rotates an arm and after a timed interval the mechanism causes the doll to assume a sitting position. There is no provision for bending the knees.

Terzian, U.S. Pat. No. 4,312,150 discloses a doll capable of raising itself in a realistic manner from a prone position to either a standing position or a sitting position. The doll's legs are pivotally mounted on the torso and the legs do not bend. The drive mechanism includes a motor and a pair of cams which control the timed leg movements.

Terzian et al, U.S. Pat. No. 4,802,878 discloses a doll having bendable arms that are movable from a position alongside the torso up toward the doll's head. Each arm has a hand attached for rotation about the wrist. When an arm is bent and moved up, the attached hand rotates. Movement of each arm is effected by a cable extending through a hollow, bendable conduit. One end of each cable is connected to a respective hand and at the other end to a control knob.

The present invention is distinguished over the prior art in general, and these patents in particular by a doll having bendable knees which is capable of moving between a standing position and a sitting position. The doll has a pair of arm members pivotally connected to a torso at the shoulder and a pair of leg members pivotally connected to the torso at the hip and each leg member has an upper leg member and a lower leg member joined thereto at the knee. The upper and lower leg members are movable relative to one another about the knee joint. The arm members are connected to the leg members inside the torso by cables. In the standing position, the arms and legs are positioned generally vertical relative to the torso.

Moving one arm member from the vertical position to raised position generally perpendicular to the torso causes simultaneous movement of the upper leg members between the standing position and a sitting position with the upper leg members aligned generally perpendicular to the torso. The lower leg may be allowed to remain in a generally vertical position and to be moved upwardly as the upper leg member is pivotally moved about the hip region to simulate bending at the knees.

The lower leg member may also be held or fixed in a generally vertical position such that the pivotal force applied to the upper leg member at the hip region is transferred to the knee joint to cause the upper leg member to be pivoted downward relative to the lower leg member about the knee joint and carry the torso downwardly therewith to simulate bending at the knees and the doll will assume a sitting position as the torso is carried down.

SUMMARY OF THE INVENTION

It is therefore an object of the present invention to provide a doll which is capable of moving between a standing and a sitting position.

It is another object of this invention to provide a doll which is capable of moving between a standing and a sitting position by bending at the knees.

Another object of this invention is to provide a doll which is capable of moving between a standing and a sitting position.

Another object of this invention is to provide a doll which is capable of moving between a standing and a sitting position which is particularly suited to educate young children in toilet training.

A further object of this invention is to provide a doll which is capable of moving between a standing and a sitting position by bending at the knees which is accomplished by pivoting the thigh member of the legs either about the hip or about the knee joint.

A still further object of this invention is to provide a doll which is capable of moving between a standing and a sitting position by bending at the knees which is simple in construction, economical to manufacture and rugged and durable in use.

Other objects of the invention will become apparent from time to time throughout the specification and claims as hereinafter related.

The above noted objects and other objects of the invention are accomplished by a doll having bendable knees which is capable of moving between a standing position and a sitting position. The doll has a pair of arm members pivotally connected to a torso at the shoulder and a pair of leg members pivotally connected to the torso at the hip and each leg member has an upper leg member and a lower leg member joined thereto at the knee. The upper and lower leg members are movable relative to one another about the knee joint. The arm members are connected to the leg members inside the torso by cables. In the standing position, the arms and legs are positioned generally vertical relative to the torso. Moving one arm member from the vertical position to raised position generally perpendicular to the torso causes simultaneous movement of the upper leg members between the standing position and a sitting position with the upper leg members aligned generally perpendicular to the torso. The lower leg may be allowed to remain in a generally vertical position and to be moved upwardly as the upper leg member is pivotally moved about the hip region to simulate bending at the knees. The lower leg member may also be held or fixed in a generally vertical position such that the pivotal force applied to the upper leg member at the hip region is transferred to the knee joint to cause the upper leg member to be pivoted downward relative to the lower leg member about the knee joint and carry the torso downwardly therewith to simulate bending at the knees and the doll will assume a sitting position as the torso is carried down.

DESCRIPTION OF THE PREFERRED EMBODIMENT

Figure 1:
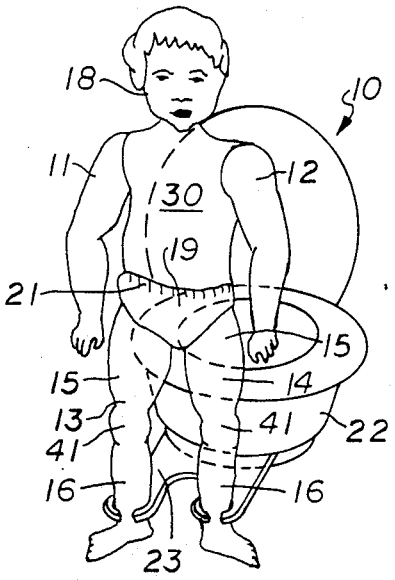
FIG. 1 is an illustration of a doll in accordance with the present invention shown in a standing position.
Figure 2:
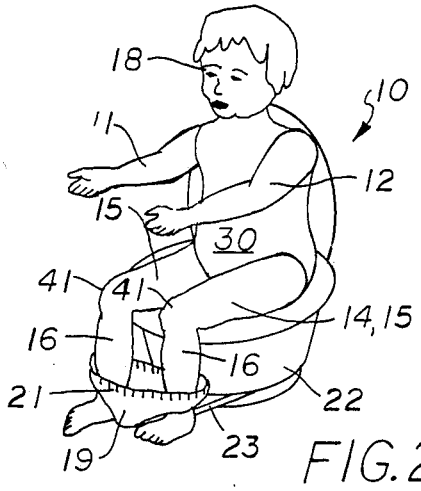
FIG. 2 is a illustration of the doll of FIG. 1 shown in a sitting position.

Referring to the drawings by numerals of reference, a preferred doll 10 in accordance with the present invention is shown in FIG. 1 in a standing position and in FIG. 2 in a sitting position.

The doll 10 has articulated right and left arm members 11 and 12 respectively, and right and left leg members 13 and 14 respectively supported on the doll torso 30. The leg members 13, 14 comprise an upper or thigh member 15 and a lower leg or calf member 16 which is pivotally connected thereto at the knee joint 17. A simulated human head 18 is carried on the torso and may be fixed or rotatably attached in a conventional manner.

The doll is capable of moving between a standing position (FIG. 1) and a sitting position (FIG. 2) by raising and lowering one of the arms 11 or 12. When the user of the doll desires to move the doll from the standing position of FIG. 1 to the sitting position of FIG. 2, the interconnected arm members 11 and 12 are rotated by moving one of the arms from the lowered position to the raised position.

While the doll, in itself, provides amusement to the user, the sitting and standing feature also allows the doll to be used in educating young children in toilet training.

For example, the doll 10 may be provided with a diaper or panty 19 having an elastic waistband 21 and may be made to sit on a commode or potty 22 by lifting one of the arms. In this embodiment, a carrier mechanism 23 is movably connected to the potty 22 and the lower leg portions 16 of the doll are releasably attached to the carrier mechanism.

Figure 3:
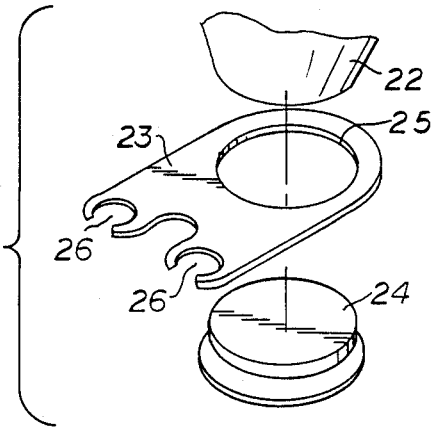
FIG. 3 is an isometric view of a carrier member which movably connects the doll to a potty.
Figure 4:
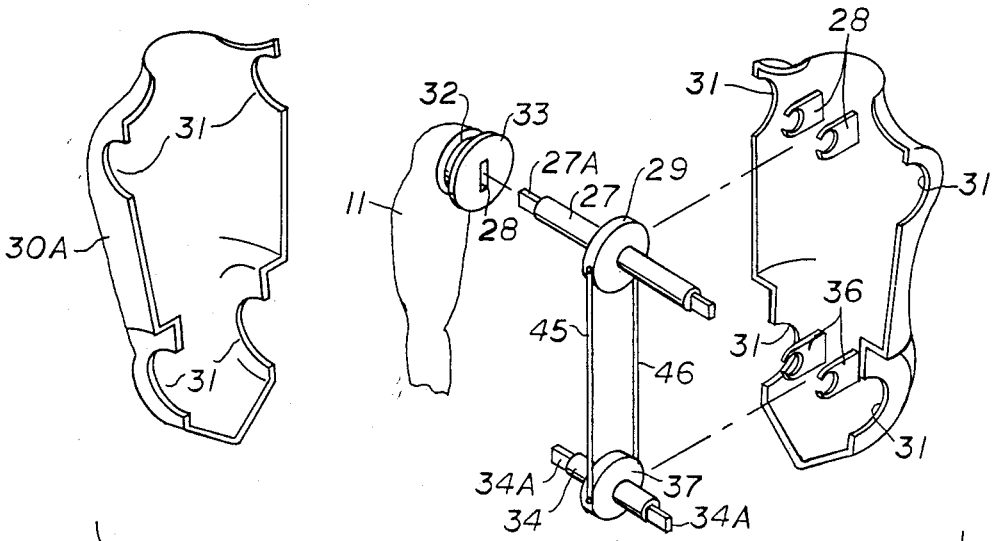
FIG. 4 is a fragmentary exploded isometric view of the torso portions of the doll showing the actuator mechanism.
Figure 7:
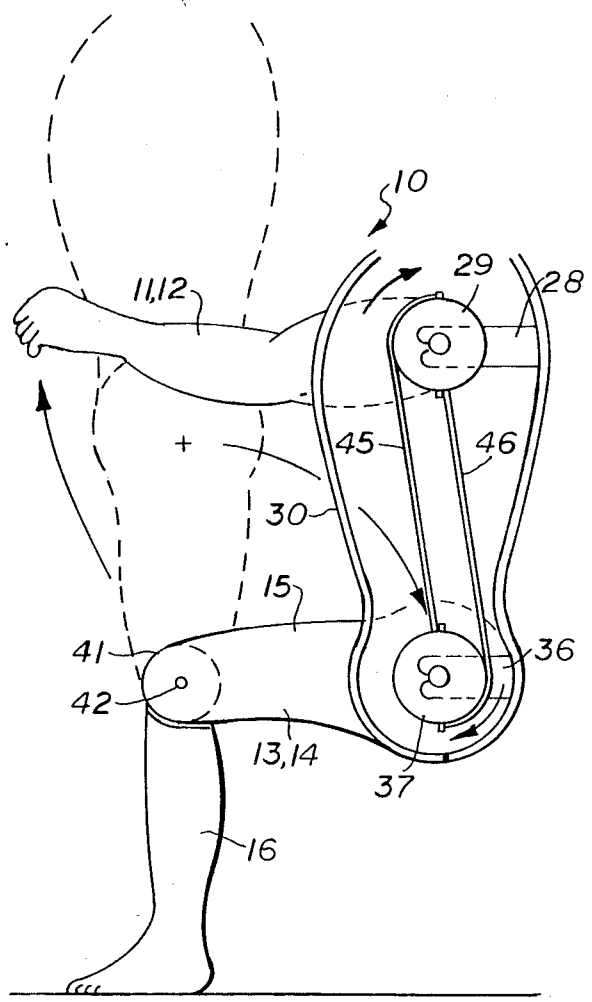
FIG. 7 is a fragmentary vertical cross section through the doll of of FIG. 4 shown from the side in the sitting position.
Figure 6:
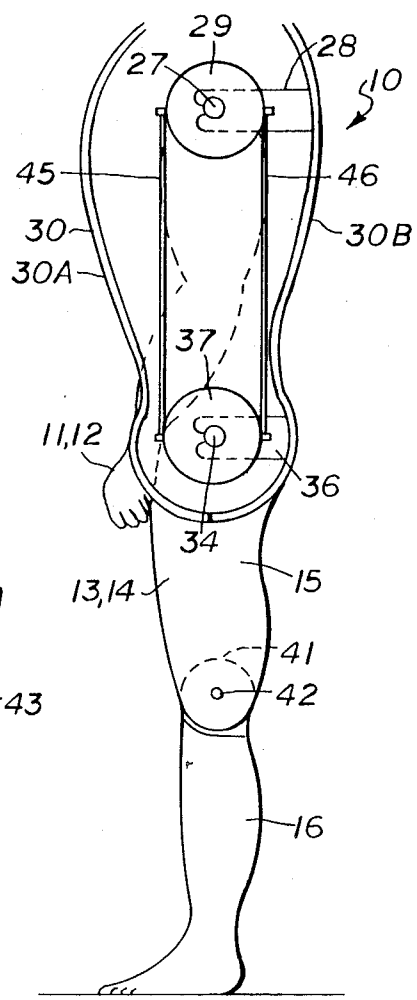
FIG. 6 is a fragmentary vertical cross section through the doll of FIG. 1 shown from the side in the standing position.
Figure 8:
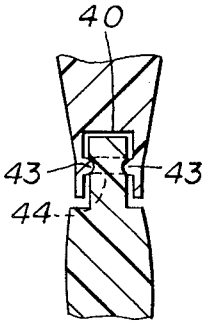
FIG. 8 is a fragmentary vertical cross section through the knee joint of the doll showing an alternative pivot connection.
Figure 5:
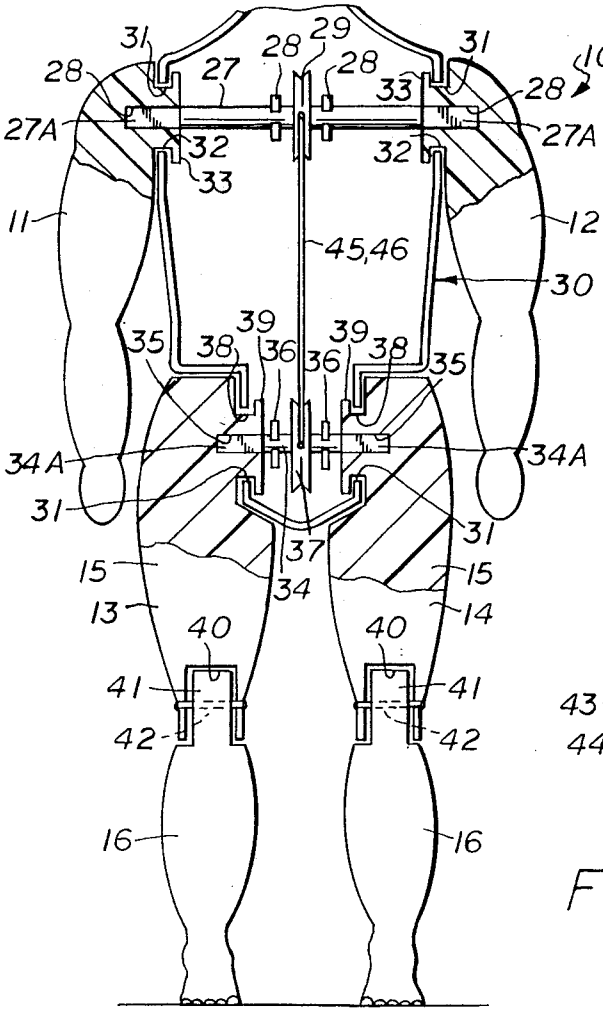
FIG. 5 is a fragmentary vertical cross section through the doll of FIG. 1 shown from the front in the standing position.

As shown in FIG. 3, the potty 22 is provided with a cylindrical base portion 24 and the carrier 23 is a rectangular member having a hole 25 through one end and having a pair of laterally spaced arcuate notched members 26 at the other end. The hole 25 of the carrier 23 is rotatably received on the cylindrical base 24 of the potty 22, and the lower portions 16 of each leg are snap fitted into the notches 26.

In this manner, the doll 10 may be attached to the carrier 23 in the standing position with the carrier pivotally rotated to one side of the front of the potty 22. To instruct the child in the toilet training procedure, the doll 10 is moved on the carrier 23 to the front of the potty 22. The diaper or panty 19 is pulled down to the ankles of the doll and then one of the arms 11 or 12 is raised, causing the doll to assume the sitting position on the potty.

Turning now to FIGS. 5–8, a more detailed discussion of the internal arrangements of the doll to accomplish the standing and sitting positions follows. The arm members 11 and 12 are interconnected by an actuator rod 27 extending transversly through the torso 30 and fixed at both ends to the arm members. The ends of the rod 27 are received within apertures 28 in the arm members and secured therein by adhesive, sonic welding or other conventional means. The actuator rod 27 is rotatably supported within the upper portion of the torso 30 by means of laterally spaced sockets 28 which extend inwardly from the interior surface of the torso. A central raised circular flange 29 is formed on the actuator rod 27 intermediate its ends and resides between the sockets 28 when the rod is positioned therein.

The torso 30 is made in two halves 30A and 30B which are engageable with one another on a line extending along the sides of the body. Semi-circular openings 31 formed in each half of the torso and form circular openings at the shoulder and hip locations of the body. The shoulder portion of each arm member 11 and 12 is provided with a circular groove 32 and an adjacent raised flange 33. The torso halves 30A and 30B are assembled together such that the groove 32 of each arm member is rotatably received within the openings 31 at the shoulder location of the body.

Similarly, the leg members 13 and 14 are interconnected by an actuator rod 34 extending transversly through the lower portion of the torso 30 and fixed at both ends to the leg members. The ends of the rod 34 are received within apertures 35 in the leg members and secured therein by adhesive, sonic welding or other conventional means. The actuator rod 34 is rotatably supported within the torso 30 by mean of laterally spaced sockets 36 which extend inwardly from the interior surface of the torso. A central raised circular flange 37 is formed on the actuator rod 34 intermediate its ends and resides between the sockets 36 when the rod is positioned therein. The diameter of the flanges 29 and 34 are substantially the same.

The hip portion of each leg member 13 and 14 is provided with a circular groove 38 and an adjacent raised flange 39. The groove 38 of each leg member is rotatably received within the openings 31 at the hip location of the body when the torso halves 30A and 30B are assembled together.

The lower end of the upper or thigh member 15 of each leg member 13, 14 is slotted 40. The upper end of the lower leg or calf member 16 is rounded to resemble a kneecap 41 and is pivotally mounted within the slot 40 by means of a pin 42. Alternatively, the inward sides of the slot 40 may be provided with projections 43 which are received in recesses or holes 44 in the sides of the kneecap 41. In this manner, the thigh member 15 and calf member 16 move relative to one another.

A pair of cables 45 and 46 extend between the flanges 31 and 39. Each cable has one end fixed to the side of the flange 31 and the other end fixed to the flange 39 in opposed relation. The cables 45 and 46 are position such that they are equally extended when the arms 11,12 and legs 13,14 are in the vertical position.

To facilitate proper relative positioning between the arms, legs, and cables, the ends of the actuating rods 27 and 34 may be flat with the flat surfaces 27A and 34A aligned with the cable connections, and the apertures 28 and 35 in the arm and leg members may be slotted, such that the flat ends of the rods will only be received in the arm and leg members when they are positioned vertically.

In this manner, the cables 45 and 46 are secured to the flanges 29 and 37, the ends of the arms 11,12 and legs 13,14 are secured to the rods 27 and 34, whereby the arms and legs are vertical and the cables are equally extended. The assembled arm and leg actuator rods 27 and 34 are placed in the sockets 28 and 36 with the grooves 32 and 38 received in the openings 31 in the torso halves. The two torso halves 30A and 30B are then joined together conventionally. The two halves 30A and 30B may be secured permanently or releasably joined together whereby they may be separated for servicing or repairing the cable assembly.

The head member 18 may be rotatably attached by providing a groove at the neck location to be rotatably received within a circular opening at the top of the torso in the same manner as the arms and legs, or the head may be formed in two halves as an integral extension of the torso halves.

OPERATION

To cause the doll to sit from the standing position, one of the arm members is pivotally raised from its lowered vertical position to pivot approximately 90 degrees about the shoulder. The arm action rotates the flange 31 on the actuator rod 27 and the cables 45 and 46 on the sides of the flange 31 simultaneously rotate the flange 39 which causes the thigh member 15 of the legs to pivot approximately 90 degrees about the hip.

If the calf member 16 is not held or fixed, the lower end of the thigh member 15 will be raised and because of the relative movement between the thigh member 15 and the calf member 16, the calf member 16 will remain in a relative vertical position, thus the legs of the doll is capable of bending at the knee joint. The calf member 16 may also be weighted to normally remain in the vertical position.

If the calf member 16 is held or fixed as one of the arms is raised, the lower end of the thigh member will tend to be raised, but because the calf member 16 is fixed and can not move, the pivotal force will be applied about the knee joint. This will cause the upper thigh member 15 to be pulled down and the doll will assume the sitting position.

It should be understood, that a doll having bendable knees provides amusement and play value as a doll in itself, and as described above, the doll 10 may be particularly adapted to be used in educating young children in toilet training. In a toilet training embodiment, the doll 10 is provided with a diaper or panty having an elastic waistband. The calf portions 16 of the legs are removably held or fixed within the arcuate notched members of the carrier mechanism 23 which rotates to one side of the front of the potty 22. The doll 10 is moved on the carrier to the front of the potty. The diaper or panty is pulled down to the ankles of the doll and then one of the arms is raised, causing the doll to assume the sitting position on the potty.

While this invention has been described fully and completely with special emphasis upon a preferred embodiment, it should be understood that within the scope of the appended claims the invention may be practiced otherwise than as specifically described herein.

I claim:

1. A doll comprising:

a doll torso portion having hip, shoulder, and side regions a pair of legs pivotally connected to said torso portion in the hip region of said doll and each having an upper leg member and the lower leg member joined thereto at the knee joint and said upper and lower leg members movable relative to one another about the knee joint, at least one arm member movably mounted to the torso and manually movable between a first position aligned generally vertically with said torso portion and a second raised position aligned generally perpendicular to said torso portion, said arm member operatively connected to said pair of legs such that manually moving said arm from the first position to the second position causes simultaneous pivotal movement of said pair of legs about the hip region of said doll between a standing position with said legs aligned generally vertically with said torso portion and a sitting position with said legs aligned generally perpendicular to said torso portion.

2. A doll according to claim 1 wherein each said upper leg member is pivotally connected to said torso portion in the hip region of said doll, each said lower leg member is pivotally joined to said upper leg member at the knee joint and movable relative to one another about the knee joint, and said arm member for moving said legs relative to said torso portion is operatively connected to said upper leg member such that manually moving said arm from the first position to the second position causes simultaneous pivotal movement of each said upper leg member about the hip region of said doll between a standing position with said upper leg member aligned generally vertically with said torso portion and a sitting position with said upper leg member aligned generally perpendicular to said torso portion and to said lower leg member, whereby said pair of legs simulate bending at the knee joints as said doll moves between the standing and sitting positions.

3. A doll according to claim 2 wherein each said lower leg member is pivotally joined at the knee joint to be raised and lowered by the knee joint in a depending generally vertical position as said upper leg member is pivotally moved about the hip region of said doll to simulate bending at the knee joints.

4. A doll according to claim 2 wherein each said lower leg member is adapted to be fixed in a generally vertical position whereby the pivotal movement force applied to said upper leg member at the hip region is transferred to the knee joint causing said upper leg member to pivot downward relative to said fixed lower leg member about the knee joint and carry said torso portion downwardly therewith as said arm member is moved from the first position to the second position and causing said upper leg member to pivot upwardly relative to said fixed lower leg member about the knee joint and carry said torso portion upwardly therewith as said arm member is moved from the second position to the first position, whereby said pair of legs simulate bending at the knee joints and said doll will assume a sitting position as said torso portion is carried down and a standing position as said torso portion is carried up.

5. A doll according to claim 2 wherein;

said lower leg members are of sufficient weight to be normally maintained in a generally vertical position whereby the pivotal movement force applied to said upper leg member at the hip region is transferred to the knee joint causing said upper leg member to pivot downward relative to said lower leg member about the knee joint and carry said torso portion downwardly therewith as said arm member is moved from the first position to the second position and causing said upper leg member to pivot upwardly relative to said fixed lower leg member about the knee joint and carry said torso portion upwardly therewith as said arm member is moved from the second position to the first position, whereby said pair of legs simulate bending at the knee joints and said doll will assume a sitting position as said torso portion is carried down and a standing position as said torso portion is carried up.

6. A doll according to claim 4 including;

a carrier member adapted to be received around the ankle region of said lower leg members for fixing said lower leg members in the generally vertical position and extending rearwardly therefrom, and a seat member connected at the rearward end of said carrier member for receiving the buttocks portion of said torso when said doll assumes the sitting position as said torso portion is carried down.

7. A doll according to claim 6 wherein said carrier rearward end is pivotally connected to said seat member, whereby said doll when attached to said carrier member may be moved pivotally between a first position at one side of the front of said seat member and a second position at the front of said seat member.

8. A doll according to claim 2 including:

an upper actuator rod rotatably mounted transversly within an upper portion of said torso and its outer ends fixed to the shoulder region of said arm members and a circular flange intermediate its ends, a lower actuator rod rotatably mounted transversly within a lower portion of said torso and its outer ends fixed to the hip region of said upper leg members and a circular flange intermediate its ends, cable means operatively connected between said circular flanges for simultaneously rotating said circular flanges, whereby pivotally moving one said arm member from the first position to the second position causes simultaneous movement of said pair of legs between said standing position and said sitting position.

9. A doll according to claim 2 wherein said torso is formed in two halves which are engageable with one another on a line extending along opposed sides of the torso with semi-circular openings formed in each half of said torso to form circular openings at the shoulder and hip locations of the body when the two halves are engaged, each said arm member having an inward facing shoulder portion with a circular groove and an adjacent raised flange and each said upper leg member having an inward facing hip portion with a circular groove and an adjacent raised flange, and said torso halves are joined together such that the groove of each said arm and leg member is rotatably received within the openings at the shoulder and hip locations of the body.

10. A doll according to claim 2 wherein;

the lower end of each said upper leg member is slotted, and the upper end of each said lower leg member is rounded to resemble a kneecap and is pivotally mounted within said upper leg member slot.

11. A doll according to claim 2 including;

an undergarment having an elastic waistband fitted around the waist of said torso which is adapted to be moved downward around the ankle region of said lower leg members.

* * * * *